US008661640B2

(12) United States Patent
Parrott

(10) Patent No.: US 8,661,640 B2
(45) Date of Patent: Mar. 4, 2014

(54) EXTRACTION SYSTEM FOR A MINERAL CUTTER PICK

(75) Inventor: George Albert Parrott, Wakefield (GB)

(73) Assignee: Minnovation Limited (GB)

( * ) Notice: Subject to any disclaimer, the term of this patent is extended or adjusted under 35 U.S.C. 154(b) by 0 days.

(21) Appl. No.: 13/580,174

(22) PCT Filed: Feb. 3, 2011

(86) PCT No.: PCT/GB2011/000136

§ 371 (c)(1),
(2), (4) Date: Aug. 21, 2012

(87) PCT Pub. No.: WO2011/101612

PCT Pub. Date: Aug. 25, 2011

(65) Prior Publication Data

US 2012/0311853 A1 Dec. 13, 2012

(30) Foreign Application Priority Data

Feb. 22, 2010 (GB) ..... 1002949.4
Jul. 7, 2010 (GB) ..... 1011427.0

(51) Int. Cl.
*B23P 19/04* (2006.01)
*E21C 25/10* (2006.01)

(52) U.S. Cl.
USPC ..... 29/252; 299/104

(58) Field of Classification Search
USPC ..... 299/104, 110, 95, 79.1; 29/252, 270, 29/700
See application file for complete search history.

(56) References Cited

U.S. PATENT DOCUMENTS

| | | | | |
|---|---|---|---|---|
| 4,337,980 | A | 7/1982 | Krekeler | |
| 5,738,415 | A * | 4/1998 | Parrott | 299/104 |
| 2008/0035386 | A1 * | 2/2008 | Hall et al. | 175/425 |
| 2008/0036277 | A1 * | 2/2008 | Hall | 299/104 |
| 2009/0019679 | A1 | 1/2009 | Hahn et al. | |
| 2009/0293249 | A1 | 12/2009 | Lehnert et al. | |

FOREIGN PATENT DOCUMENTS

WO 9839553 A1 9/1998

OTHER PUBLICATIONS

Intl. Search Rpt, EP, Jan. 19, 2012, Minnovation Limited.
Written Opinion, EP, Jan. 19, 2012, Minnovation Limited.

* cited by examiner

*Primary Examiner* — Lee D Wilson
*Assistant Examiner* — Nirvana Deonauth
(74) *Attorney, Agent, or Firm* — Hooker & Habib, P.C.

(57) ABSTRACT

A system for extraction of a mineral cutter pick (1), and optionally any interposed sleeve (19), the pick (1) comprises an elongate shank (4) extending from an enlarged head (2), has a piston (12) coaxial with the shank (4), with one end face (16) of the piston (12) subjectable to hydraulic pressure fluid, and with another, opposite end face (15) of the piston (12) capable of engaging an end face (5) of the shank (4), a sealing ring (14) to prevent passage of hydraulic fluid being carried by the piston (12), whereby axial movement of the piston (12), under hydraulic pressure, in turn axially displaces the pick (1), while further movement of the piston (12) results in extraction, if required, of sleeve (19).

20 Claims, 4 Drawing Sheets

EXTRACTION SYSTEM FOR A MINERAL CUTTER PICK

FIELD OF THE INVENTION

This invention relates to an extraction system for a mineral cutter pick and, optionally, any sleeve interposed between a shank of the pick and a receiving bore of a pick box (also known as a block) in which the pick is releasably retained. Mineral cutter picks are used extensively in mining of minerals such as coal, in the driving of underground roadways or tunnels, and in the planing of asphalt or concrete road surfaces as part of road surface renewal.

BACKGROUND OF THE INVENTION

Rotary cutting heads of mining machines or machines for the driving of underground roadways or tunnels, are conventionally provided with a plurality e.g. 50-150 blocks welded in place, each to receive a replaceable cutter pick provided with a carbide tip, each block having a receiving bore to receive a close fitting shank of the pick either directly, or more usually with an interposed sleeve.

Pick replacement is normally required after a certain degree of wear, loss of a tip, or pick breakage, and has usually required manual removal e.g. by the use of a chisel, drift, hammer etc with risk not only of sparks but also of flying metal particles, requiring variable degree of manual force. However, for various reasons, some picks may be impossible to remove manually and can only be removed after removing the entire sleeve or, in some cases, the block. This may mean removal of the rotary cutting head from its machine for transport to the surface of a coal mine, or to a safe area, where burning and welding operation can be carried out.

In the planing of road surfaces in preparation for re-surfacing operations, rotary cutting drums of road surface planing machines are conventionally provided with possibly 150 blocks, each to receive a replaceable cutter pick provided with a carbide tip, each pick box having a receiving aperture to receive a wear sleeve, with a shank of the pick engaged in the sleeve.

The need to accommodate a relatively large number of picks around the external periphery of the drum of a road planing machine, constrains the size of pick that can be used, and typical road planing picks have shanks of say 20 mm or ½ inch diameter. The result is the inevitable breakage of a large number of picks and the consequent need to remove the remains of a broken pick from the receiving bore of a block in which aperture the shank is located, usually with an interposed wear sleeve. Even if breakage has not occurred, regular pick replacement is required to counter the effects of wear and/or loss of a carbide tip.

In one known mechanical removal system an operative engages in a drift, against an end face of the shank of the pick, to push or prise the shank from the sleeve, or hammers a wedge against the end face.

Another current mechanical system for pick extraction, but which is in extensive use, employs a two pronged fork with wedge tines, which tines are hammered by an operative under a collar of the pick specifically provided for extraction purposes. These extraction procedures might need to be repeated 100 times or more depending on the nature of the cutting drum and the number of blocks welded, in predetermined array, around its external periphery.

In EP 1064453 is a proposal for hydraulic extraction of the shank of a pick holder located in a blind bore, whereby the shank of a pick holder is provided with a sealing ring to seal against the shank-receiving bore of the block, and hydraulic pressure is applied to the end face of the shank. In this system, the end of the pick is exposed and so can be knocked out by a hammer, and/or a drift can be engaged with a groove in the pick head.

However, in extensive use is a sleeved system as shown in GB 2285464, and here the means of achieving sleeve extraction (the pick can again be removed manually) is to step the sleeve, to provide sealing rings at either side of the step, and to introduce hydraulic fluid to the zone between the sealing rings. Whilst this system provides a solution for sleeve extraction, manual pick extraction can still be problematical and/or hazardous.

Both the above proposals for hydraulic extraction, whilst achieving the desired results, require modification from industry standard, of sleeve and/or block.

Furthermore, it will be appreciated that whilst the majority of picks can be successfully removed with a lever or wedge, inevitably with an unfavourable combination of manufacturing tolerances of a shank diameter etc plus the impacts received by the pick in service, it may prove impossible to extract a seized or broken pick manually from its sleeve.

OBJECT OF THE INVENTION

A basic object of the invention is the provision of a system for hydraulic extraction of:—

(i) a pick from a receiving bore of a block, in a non-sleeved system;

(ii) a pick from a receiving bore of a sleeve, in a sleeved system, and also when required the sleeve from the receiving bore of a block;

(iii) a sleeve and a seized or broken pick as a unit, from a block of a sleeved system.

Summary of a First Aspect of the Invention (Non-Sleeved)

According to a first aspect of the invention, there is provided a system for extraction of a mineral cutter pick, comprising an elongate shank extending from an enlarged head, from a receiving bore in which the shank is releasably fitted, characterised in that a piston coaxial with the shank is provided, with one end face of the piston subjectable to hydraulic pressure fluid, and with another, opposite end face of the piston capable of engaging an end face of the shank, and with a sealing ring to prevent passage of hydraulic fluid carried by the piston, whereby axial movement of the piston, under hydraulic pressure, in turn axially displaces the pick along the bore for extraction purposes.

Summary of a Second Aspect of the Invention (Sleeved)

According to a second aspect of the invention, there is provided a system for extraction of a mineral cutter pick and, if required, a sleeve, the latter comprising an enlarged head from one side of which extends a tubular body portion, has the tubular body portion located in a receiving bore of a block and the pick shank located in a receiving bore of the elongated body portion, characterised in that a headed piston coaxial with both the shank and the sleeve is provided, with one end face of the head of the piston subjectable to hydraulic pressure fluid, and another, opposite end face of the piston engageable with an end face of the pick shank, both the piston and sleeve carrying sealing rings to prevent passage of hydraulic fluid, whereby axial movement of the piston, under hydraulic pressure, in turn axially displaces the pick with respect to the sleeve, until the piston head eventually engages the sleeve with, if required, continued admission of pressure fluid causing displacement of the sleeve axially with respect to the block.

ADVANTAGES OF THE INVENTION

The two aspects of the invention enable an unmodified, industry-standard pick to be extracted from a receiving bore, and furthermore, in the event that an interposed sleeve is present, similarly enables sleeve extraction from a receiving bore.

It will be appreciated that sleeve extraction (for replacement) is a relatively rare requirement compared with pick replacement, and would only be necessary if the sleeve, and in particular its enlarged head, had been allowed to become worn or damaged e.g. by a broken, or lost pick not being replaced in good time, or if a pick had become jammed, seized, rusted or broken such that the entire pick and sleeve as a unit needed to be extracted from the block, with a rusted-in sleeve being a particular problem, as coal mines in particular usually demand a "wet" system, with one or more water sprays being located in the vicinity of the pick, for a variety of well known reasons.

Clearly, a pressure fluid supply port needs to be connectable from a source of pressure fluid to deliver pressure fluid to the vicinity of the first end face of the piston.

In tests, it has been found that non-problem picks can be extracted with relative ease, at low pressures, of around 50 psi, whereas a fluid pressure e.g. of 4000-5000 psi might be required to extract a sleeve, or sleeve and pick as a unit.

It will also be apparent, that the piston diameter(s) need(s) to be so selected that with whatever hydraulic pressure is available (in a coal mine at least 5000 psi is normally available) this pressure should be sufficient to displace the pick, and if required the sleeve.

Preferred or Optional Features

In the non-sleeved system, the bore is provided in a block. Consequently, the sealing ring carried by the piston engages the bore of the block. The bore is a blind bore. The piston is not headed, but of constant diameter, save for a circumferential groove to house an elastomeric sealing ring.

In a first embodiment of a sleeved system, the tubular body portion is of extended length compared with an industry-standard sleeve, so that the piston can be housed wholly within the sleeve.

The tubular body portion comprises two coaxial, internal bores separated by an annular, internal collar of diameter corresponding to that of the piston, one bore being an outer bore adapted, in use, to releasably house a shank of a mineral cutter pick, and the other bore being an inner bore to house the piston.

The annular, internal collar is provided with a sealing ring slidably engageable with the external periphery of the portion of the piston passing through the collar:

The enlarged head of the piston also carries a sealing ring.

An additional sealing ring, to seal between the external periphery of the sleeve and the receiving bore of the block, is carried by a circumferential groove of the sleeve.

In a second embodiment of a sleeved system, the sleeve is not extended as in the first embodiment, but is of industry-standard length, the receiving bore of the block is extended such that the piston may be partially housed in the bore of the block, and partially in the bore of the tubular body portion of the sleeve.

The sleeve is stepped externally, and is provided with a first sealing ring adjacent its enlarged head, and a second sealing ring adjacent the end of the tubular body portion distal from the enlarged head.

The sleeve is also stepped internally as is the shank.

In a third embodiment of sleeved system suitable for road planing, the receiving bore of the block is a parallel sided through bore.

The through bore has an annular internal rib at a rear end against which is abutted a bore closure disc having a fluid flow bore extending to an external nipple, for attachment of for example a manually operable grease type gun, when hydraulic extraction is required, although, if required, as an alternative, a removable, screw-in, screw-out plug could be provided, the plug being removed for the attachment of a hydraulic hose fitting.

Instead of providing the nipple in a portion of the pick box, the closure disc may carry the nipple for both admittance and exhaust of hydraulic fluid.

The hydraulic hose fitting is of a snap-on, quick release type, avoiding the need to screw a coupling onto the nipple.

With a hand operable pump of the grease gun type used to supply hydraulic fluid via a flexible high pressure hose (readily available thermoplastic hose can accommodate 600 bars/8700 psi), to extraction of a pick, then provided the hydraulic pressure behind the piston is released, the pushing in of a new replacement pick in turn pushes the piston back to its start position, and return the oil to the tank/chamber, ready for re-use with the next extraction.

Alternatively, the nipple could be provided in a tapped hole of the block.

BRIEF DESCRIPTION OF THE DRAWINGS

In the accompanying drawings.

DETAILED DESCRIPTION OF THE DRAWINGS

Figure 2:
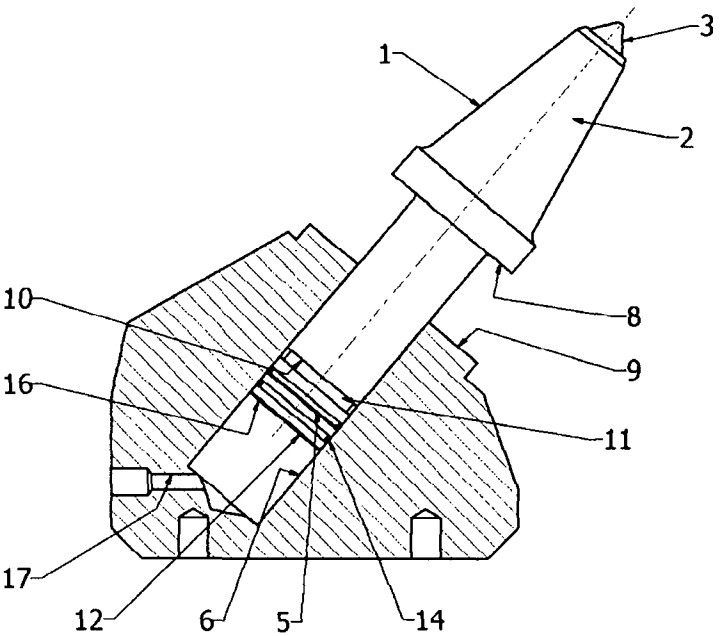
FIGS. 1 and 2 show the extraction of a non-sleeved, coal etc cutter pick from a block.

In all figures, like reference numerals are used for like components.

Figure 1:
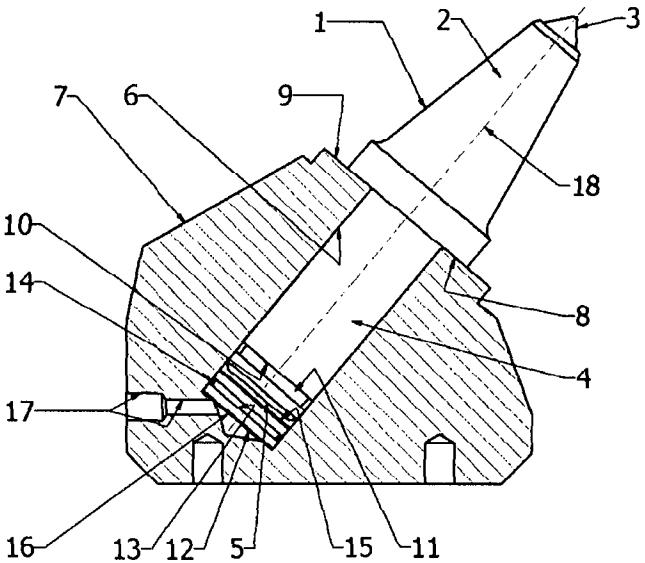

In FIGS. 1 and 2, a coal etc cutter pick 1 having an enlarged head 2 provided with a carbide tip 3, is secured by an integral, cylindrical shank 4, having an end face 5, in a blind receiving bore 6, of constant diameter, drilled into a block 7, which block is adapted to be secured, by welding, around the periphery of a drum or disc (not shown) of a mineral winning machine, a tunnel or roadway driving machine, or a road planing machine, the pick head 2 and specifically the carbide tip 3 impacting on the mineral etc involved.

When the pick 1 is fitted into the block 7 as illustrated in FIG. 1, an annular seating surface 8 of the enlarged head 2 engages a seating surface 9 provided by the block 7, whilst inadvertent loss of the pick 1 from the block 7 is resisted by providing a circumferential groove 10 in the shank 4, and locating a spring clip 11 in the groove 10 to make frictional engagement with the bore 6.

The length of the bore 6 exceeds that of the shank 4 so that a piston 12 may be coaxially located in the bore 6 beyond the end face 5 of the shank 4. The piston 12 has a circumferential groove 13 in which is located an elastomeric, fluid sealing ring 14 and opposed end faces 15 and 16, the face 15 being adapted to abut the end face 5 of the shank 4 when hydraulic fluid, supplied via a tapped port 17 in the block 7, is applied to the full area of the face 16. The port 17 is closed either by a screw-in plug, when hydraulic extraction is not required, or by a screw-in grease nipple, which could be left permanently in place. Pick changing is of course frequently required, typically on a daily or even every shift basis, to replace a worn or broken pick 1, necessitating the extraction of the pick 1 from its block 7. The problems of pick extraction have already been outlined.

In accordance with the invention, the pick 1, which has a longitudinal axis 18, is no longer extracted manually, but on the contrary is extracted by hydraulically displacing the piston 12 axially, which in turn axially displaces the pick 1 from the fully engaged position shown in FIG. 1, to a partially ejected position shown in FIG. 2, from which partially ejected position the pick 1 may be pulled, by hand, and a fresh pick inserted by hand. The piston 12 in effect pushes the pick 1 from the block 7. Furthermore, with the fluid pressure released, the pushing in of a fresh pick not only pushes the piston 12 back to the bottom of the bore 6 from the position illustrated in FIG. 2 to the position illustrated in FIG. 1, but also, advantageously, returns the pressure fluid (preferably a water/oil emulsion) to a reservoir.

Figure 4:
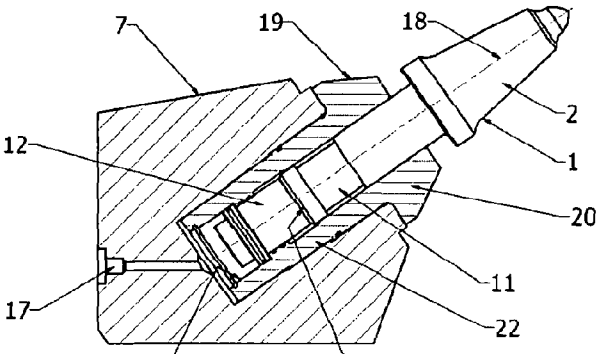
FIGS. 3, 4 and 5 show a first embodiment of a sleeve system, also for a coal etc cutter pick.
Figure 3:
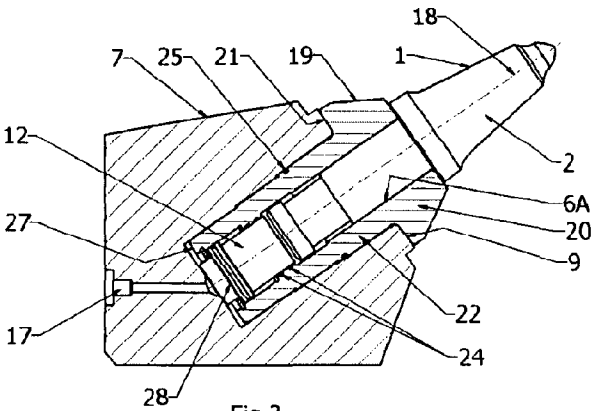
Figure 5:
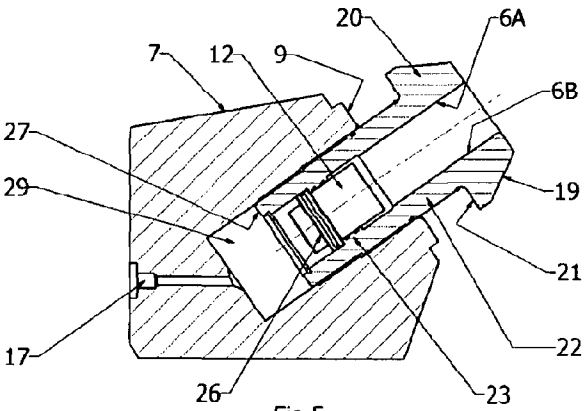

In FIGS. 3, 4 and 5 is illustrated a first embodiment of a sleeved system, whereby a sleeve 19 is interposed between the pick 1 and the block 7. Thus the sleeve 19 is located in the bore 6, and comprises an enlarged head 20 providing an annular seating surface 21 to bear on the seating surface 9 provided by the block 7, from which enlarged head 20 extends a tubular body portion 22 providing a bore 6A. The bore 6A is defined by two, coaxial bore parts, being an outer bore part 6B to house the shank 4 of a pick 1, and a coaxial inner bore part 6C to house the piston 12, the parts 6B and 6C being separated by an annular, internal collar 23 of diameter corresponding to that of a portion of the piston 12 that slidingly passes through the collar 23 and is provided with a fluid sealing rings 24 to engage the periphery of that portion of the piston 12. Multiple circumferential external grooves provided in the tubular body portion 22 of the sleeve 19 each retain an elastomeric, fluid sealing rings 25 adapted to make sliding, fluid sealing engagement, with the bore 6. Rings 25 at each end of the sleeve 19 seal the sliding contact area between the external periphery of the sleeve 19 and the receiving bore in the block 7, thus preventing any water entry so that the contact area remains rust free so minimizing the forces required to extract the sleeve 19 as the latter cannot become rusted-in.

The piston 12 has an enlarged head 26 located in the bore part 6C, whilst at its end distal from the head 26, the tubular body portion 22 of the sleeve 19 terminates in an annular end surface 27, in the vicinity of which a circlip 28 is located to ensure retention of the piston 12 within the bore part 6C.

Upon initial admission of hydraulic fluid via port 17 the piston 12 is axially displaced until the piston 12 eventually reaches the position shown in FIG. 4 in which the enlarged head 26 abuts the internal collar 23. Such displacement pushes the pick 1 partially out of the sleeve 19, and after such initial un-seating of the pick 1, the pick can be fully removed by hand, without difficulty, to be replaced by a fresh pick. As before, with the pressure released, the manual pushing in of a fresh pick returns the piston 12 to the position shown in FIG. 3, and returns the hydraulic fluid to a reservoir.

In less frequent circumstances where it is also required to replace a worn or broken sleeve 19, then from the position illustrated in FIG. 4, continued admission of pressure fluid to chamber 29, with the pressure fluid effective not only on the area of the enlarged head 26 of the piston 12, but also on the area of the annulus surface 27 of the sleeve 19, ejects the sleeve 19 from the bore 6, as shown in FIG. 5. Again, with this initial un-seating of the sleeve 19, the sleeve 19 can be fully removed by hand for replacement by a fresh sleeve.

Figure 7:
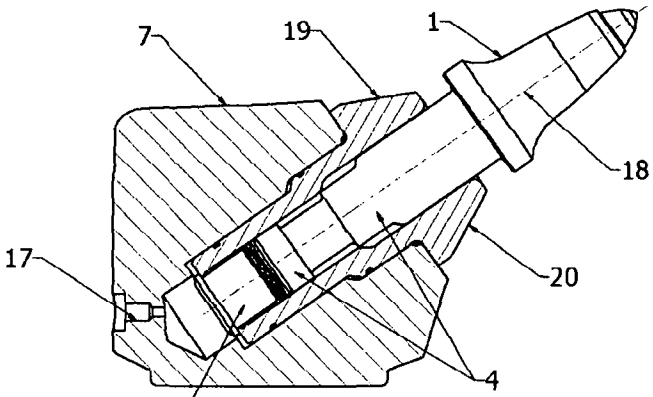
FIGS. 6, 7 and 8 show a second embodiment of a sleeved system, also for a coal etc cutter pick.
Figure 6:
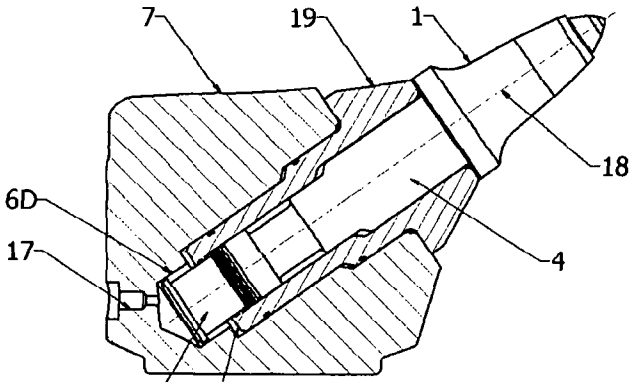
Figure 8:
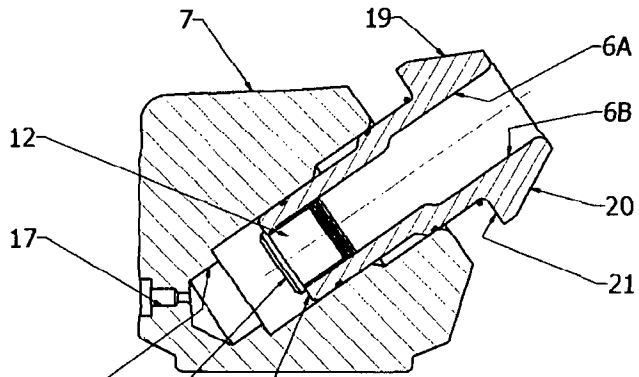

The embodiment of FIGS. 6-8 is also sleeved, similarly to that of FIGS. 3-5 except that the bore 6 is extended into bore part 6D to accommodate a portion of the piston 12, as the piston 12 is partially located within the bore part 6D and partially with the sleeve 19. But the principle of operation is the same, in that, upon first admission of pressure fluid via port 17, the piston 12 has no effect on the sleeve 19 but only displaces the pick 1 to the position illustrated in FIG. 7 when the enlarged head 26 of the piston 12 abuts the annular end surface 27 of the sleeve 19, whereupon should extraction of the sleeve 19 also be required, continued admission of pressure fluid would cause ejection of the sleeve 19 to the position illustrated in FIG. 8.

The embodiment of FIGS. 9-12 is again a sleeved system with the piston 12 wholly located within the sleeve 19, but the bore 6 is a through bore having an annular rib 30 at an end of the bore 6 distal from the seating surface 9. The end of the bore 6 adjacent the rib 30 is closed off by insertion of a plug 31 which abuts the rib 30 and has an annular groove 32 carrying a ring 33 which sealingly engages a portion of the bore 6, whilst a pressure fluid entry/exit nipple 34 is machined into an outer face of the plug 31. The plug 31 is provided with a first pressure fluid entry/exit port 35 and a second coaxial port 36 in the vicinity of the nipple 34, the port 36 being of minimal diameter to counter any propensity for blockage by dust/dirt particles.

Figure 10:
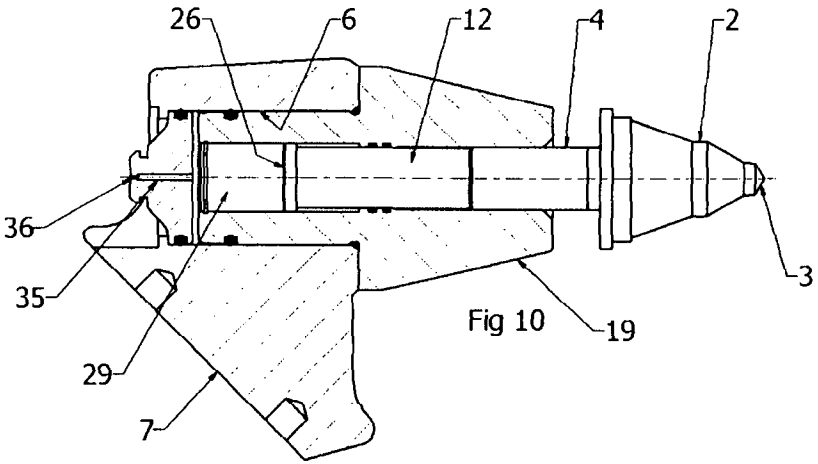
FIGS. 9, 10, 11 and 12 show a third embodiment of a sleeved system for road planing.
Figure 9:
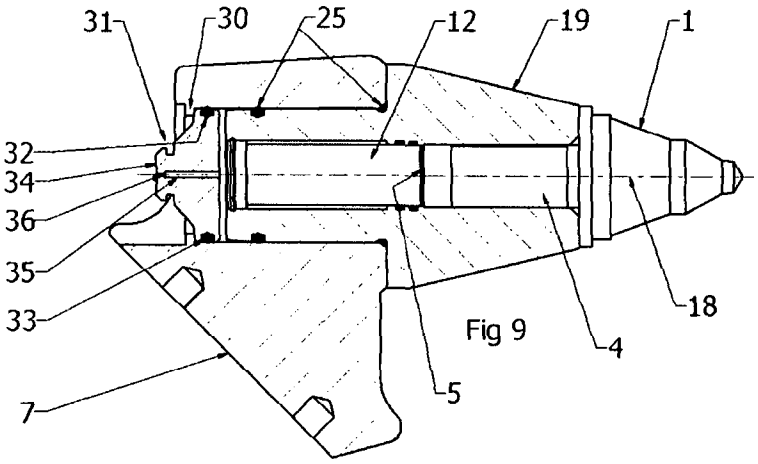
Figure 12:
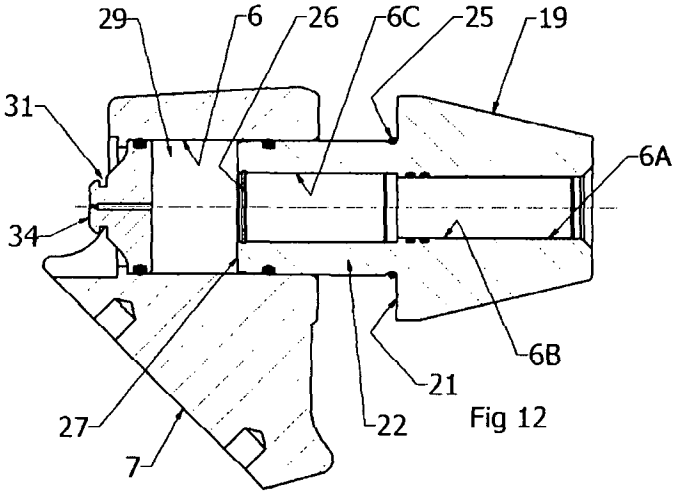
Figure 11:
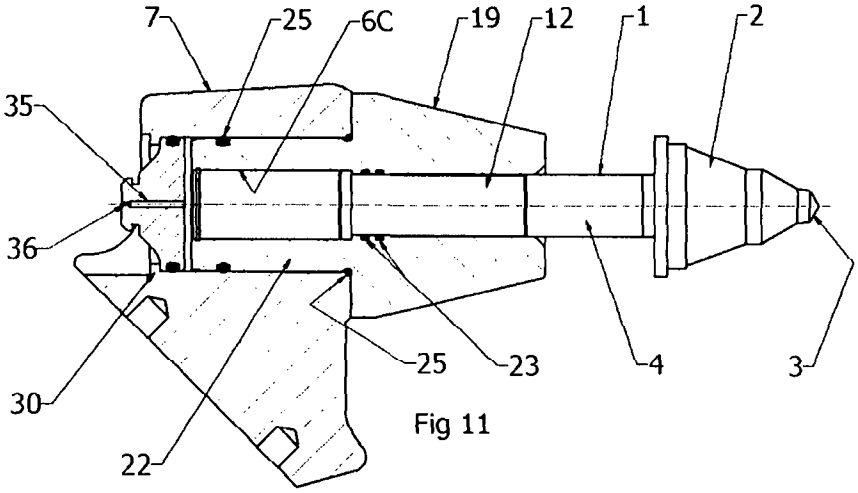

From the "start" position illustrated in FIG. 9, admission of pressure fluid e.g. by manually attaching a horseshoe hose connector (not shown) to the nipple 34 to chamber 29 displaces the piston 12 axially, which in turn pushes the pick 1 from its fully seated position in FIG. 9 to its partially ejected position in FIG. 10, from where the pick can be manually removed with ease followed by insertion of a fresh pick. Again, if sleeve removal is required, then continued admission of pressure fluid to the chamber 29 unseats the sleeve 19 and pushes it from the position indicated in FIG. 11 to the ejected position indicated in FIG. 12, from which it can be readily removed, by hand.

The invention claimed is:

1. A block assembly carrying a sleeved cutter pick for use with a rotary cutting head, the block assembly comprising:

a block, a cutter pick, a sleeve, and a piston;

the block comprising a bore having an open end and a closed end;

the sleeve comprising a tubular body comprising an upper end and an opposite lower end, the body defining a bore extending through the body, the sleeve received in the block bore with the lower end of the sleeve body in the block bore;

the sleeve bore and the block bore cooperatively defining a piston bore extending from the closed end of the block bore to an upper end of the piston bore spaced from the closed end of the block bore;

the piston in the piston bore and comprising an upper side facing the upper end of the piston bore and an opposite lower side facing the closed end of the block bore, the piston sealingly dividing the piston bore into an upper bore portion on the upper side of the piston and a lower bore portion on the lower side of the piston;

the piston slideable in the piston bore relative to the sleeve away from the closed end of the block bore from a lower position to an upper position in the piston bore spaced from the lower position, the sleeve obstructing further motion of the piston from the upper position away from the closed end of the block bore;

the cutter pick comprising a head configured to hold a cutter tip and a shank extending from the head to a free end of the shank, the shank received in the bore of the sleeve body, the free end of the shank located in the piston bore between the lower position of the piston and the upper position of the piston;

the piston disposed in the piston bore between the closed end of the block bore and the shank, the shank in the path of piston movement from the lower position to the upper position of the piston such that the shank engages the piston as the piston moves towards the upper position, the piston and shank configured so that the piston is spaced from the upper position when the piston engages the shank; and a fluid inlet opening into the block bore between the lower position of the piston and the closed end of the block bore, the fluid inlet configured to be connected to a source of pressurized fluid to flow pressurized fluid into the block bore urging movement of the piston away from the closed end of the block bore;

whereby the flow of pressured fluid through the fluid inlet drives the piston to the upper position of the piston, causing the piston to thereby engage and displace the cutter pick relative to the sleeve away from the closed end of the block bore and then to engage and displace the sleeve away from the closed end of the block bore.

2. The block assembly of claim 1 wherein the piston is at least partially disposed within the bore of the sleeve body when the piston is in the lower position.

3. The block assembly of claim 2 wherein the entire piston is disposed within the bore of the sleeve body when the piston is in the lower position.

4. The block assembly of claim 3 wherein the bore of the sleeve body extends along an axis and comprises a first bore portion extending axially from the lower end of the sleeve body, a second radially-reduced bore portion extending axially from the first bore portion, and an annular surface extending radially between the first and second bore portions, the piston engaging said annular surface when the piston is located in the upper position.

5. The block assembly of claim 4 wherein the piston comprises a radially-enlarged lower portion on the lower side of the piston and a radially-reduced upper portion on the upper side of the piston, the lower portion of the piston in the first bore portion of the sleeve body and the upper portion of the piston extending into the second bore portion of the sleeve body when the piston is in the lower position.

6. The block assembly of claim 5 wherein the sleeve body carries one or more annular sealing rings, each sealing ring engaged with the upper portion of the piston to form a seal therebetween.

7. The block assembly of claim 5 wherein the sleeve body bore comprises a third bore portion extending axially from the second bore portion, the third bore portion being radially enlarged in comparison to the second bore portion.

8. The block assembly of claim 3 wherein the sleeve comprises an annular member extending into the sleeve bore adjacent the lower end of the sleeve body, the lower side of the piston engaged against the annular member when the piston is in the lower position.

9. The block assembly of claim 2 wherein the piston extends along an axis and comprises a radially-reduced upper portion on the upper side of the piston and a radially-enlarged lower portion on the lower side of the piston, the lower portion of the piston disposed outside of the sleeve body bore, the upper portion of the piston extending into the sleeve body bore.

10. The block assembly of claim 9 wherein the sleeve body comprises an annular end surface on the lower end of the sleeve body, the lower portion of the piston engaging the end surface of the sleeve body when the piston is located in the upper position.

11. The block assembly of claim 9 wherein the sleeve body bore is surrounded by a wall of said sleeve body and the upper portion of the piston carries one or more annular sealing rings, each sealing ring engaged with the wall of the sleeve body to form a seal therebetween.

12. The block assembly of claim 1 wherein the sleeve body bore is surrounded by a wall of said sleeve body and the piston carries one or more annular sealing rings, each sealing ring engaged with the wall of the sleeve body to form a seal therebetween.

13. The block assembly of claim 1 wherein the block bore is surrounded by a wall of said block, the sleeve body carries one or more annular sealing rings, and each sealing ring is engaged with the wall of the block to form a seal therebetween.

14. The block assembly of claim 13 wherein the sleeve body extends along an axis and comprises a radially reduced lower portion extending axially from the lower end of the sleeve body and a radially enlarged upper portion extending axially from the lower portion of the sleeve body, at least one of the said one or more annular sealing rings is carried by the lower portion of the sleeve body, and at least one of the said one or more annular sealing rings is carried by the upper portion of the sleeve body.

15. The block assembly of claim 1 wherein the sleeve body is stepped internally, as is the shank.

16. The block assembly of claim 1 wherein the block comprises a block body, a through-bore in the block body, and a member not integral and homogenous with the block body closing an end of the through-bore.

17. The block assembly of claim 16 wherein the block body comprises an annular rib extending into the through-bore of the block body, the member abutting against the rib to close the end of the through-bore.

18. The block assembly of claim 17 wherein the fluid inlet is formed in the member.

19. The block assembly of claim 16 wherein the through-bore in the block body is a parallel-sided through-bore.

20. The block assembly of claim 1 wherein the block is an integral and homogenous one-piece body.

* * * * *